US005702571A

United States Patent [19]

Kamps et al.

[11] Patent Number: 5,702,571

[45] Date of Patent: Dec. 30, 1997

[54] SOFT HIGH BULK TISSUE

[75] Inventors: Richard Joseph Kamps, Wrightstown; Janica Sue Behnke; Fung-jou Chen, both of Appleton; Darnell Clarence Radtke, Shiocton, all of Wis.

[73] Assignee: Kimberly-Clark Worldwide, Inc., Neenah, Wis.

[21] Appl. No.: 648,527

[22] Filed: May 13, 1996

Related U.S. Application Data

[62] Division of Ser. No. 195,762, Feb. 18, 1994, Pat. No. 5,562,805.

[51] Int. Cl.[6] ..... D21H 27/02; D21H 27/30

[52] U.S. Cl. ..... 162/117; 162/109; 162/123; 428/172

[58] Field of Search ..... 162/111, 109, 162/113, 117, 123, 361, 362; 428/172, 184, 340; 264/282, 284

[56] References Cited

U.S. PATENT DOCUMENTS

| | | | |
|---|---|---|---|
| Re. 27,453 | 8/1972 | Schutte et al. | 162/117 |
| 3,817,827 | 6/1974 | Benz | 162/113 |
| 3,940,529 | 2/1976 | Hepford et al. | 428/178 |
| 3,994,771 | 11/1976 | Morgan, Jr. et al. | 162/113 |
| 4,125,430 | 11/1978 | Grossman | 162/207 |
| 4,236,963 | 12/1980 | Busker | 162/271 |
| 4,339,088 | 7/1982 | Niedermeyer | 242/1 |
| 4,671,983 | 6/1987 | Burt | 428/179 |
| 4,759,967 | 7/1988 | Bauernfeind | 418/154 |
| 5,098,519 | 3/1992 | Ramasubramanian et al. | 162/109 |
| 5,269,983 | 12/1993 | Schultz | 364/25 |
| 5,356,364 | 10/1994 | Veith et al. | 493/395 |
| 5,409,572 | 4/1995 | Kershaw et al. | 162/109 |

FOREIGN PATENT DOCUMENTS

| | | | |
|---|---|---|---|
| 0117351 | 9/1984 | European Pat. Off. | D61F 13/18 |
| 0303528 | 2/1989 | European Pat. Off. | D21H 5/12 |
| 0426288 | 5/1991 | European Pat. Off. | D21F 11/14 |
| 0475671 | 3/1992 | European Pat. Off. | D21H 25/00 |
| 0565838 | 2/1993 | European Pat. Off. | D21H 27/02 |
| 0613979 | 9/1994 | European Pat. Off. | D21F 11/14 |
| 1235126 | 2/1967 | Germany . | |
| 2166690 | 5/1986 | United Kingdom | B31F 1/07 |
| WO8503029 | 7/1985 | WIPO | B31F 1/07 |
| WO9424366 | 10/1994 | WIPO | D21F 11/00 |

*Primary Examiner*—Donald E. Czaja
*Assistant Examiner*—Jose A. Fortuna
*Attorney, Agent, or Firm*—Gregory E. Croft

[57] ABSTRACT

Tissue sheets, such as are useful for facial or bath tissue, can be embossed with a fine scale embossing pattern to increase bulk with a minimal loss in strength. The fine scale embossing pattern contains at least about 15 discrete intermeshing embossing elements per square centimeter (100 per square inch) and can enable the tissue manufacturer to produce premium quality tissues having adequate softness, bulk and strength from conventional tissue basesheets without layering or throughdrying equipment. Depending on the starting basesheet material, tissues having a unique balance of properties can be produced, especially for conventional wet-pressed basesheets.

6 Claims, 5 Drawing Sheets

W=Wet Press T=Through Dried M=Invention

W=Wet Press T=Through Dried M=Invention

W=Wet Press T=Through Dried M=Invention

W=Wet Press T=Through Dried X=Invention

SOFT HIGH BULK TISSUE

This application is a divisional of application Ser. No. 08/195,762 entitled "METHOD FOR MAKING SOFT HIGH BULK TISSUES" and filed in the U.S. Patent and Trademark Office on Feb. 18, 1994 now U.S. Pat. No. 5,562,805. The entirety of this application is hereby incorporated by reference.

BACKGROUND OF THE INVENTION

In the manufacture of soft tissue products such as facial, bath and towel tissue, an aqueous suspension of papermaking fibers is deposited onto a forming fabric from a headbox. The newly-formed web is thereafter dewatered, dried and creped to form a soft tissue sheet. The trend in premium tissue manufacture has been to provide softer, bulkier, less stiff sheets by layering, throughdrying and basis weight reductions. Layering, which requires a headbox equipped with headbox dividers, enables the tissue manufacturer to engineer the tissue by placing softer feeling fibers in the outer layers while placing the stronger fibers, which generally do not feel as soft, in the middle of the tissue sheet. Throughdrying enables the manufacturer to produce a bulky sheet by drying the sheet with air in a noncompressive state. Reducing the basis weight of the sheet reduces its stiffness and, when used in conjunction with throughdrying, a single-ply tissue sheet of adequate caliper and performance for a premium product can be attained.

However, producing a premium tissue product of adequate softness, bulk and strength on conventional (wet-pressed) tissue machines is not easily accomplished. For example, layering requires the purchase of a layered headbox, which is expensive. Higher bulk can be achieved by embossing, but embossing normally requires a relatively stiff sheet in order for the sheet to retain the embossing pattern. Increasing sheet stiffness negatively impacts softness. Conventional embossing also substantially reduces the strength of the sheet and may lower the strength below acceptable levels in an effort to attain suitable bulk. Reducing the basis weight of the sheet will decrease its stiffness, but may require that two or more of such low basis weight sheets be plied together to retain the desired caliper and performance. In terms of manufacturing economy, multiple-ply products are more expensive to produce than single-ply products, but single-ply products generally lack sufficient softness and bulk, especially when manufactured on conventional machines.

Accordingly there is a need for a simple means of enabling conventional tissue machines to produce premium quality tissue sheets having adequate softness, bulk and strength without the expense of purchasing a layered headbox or a throughdryer, or manufacturing multiple plies.

SUMMARY OF THE INVENTION

It has now been discovered that a strong, soft and bulky tissue sheet of premium quality can be produced from basesheets made with conventional tissuemaking assets, although the method of this invention can also be used to improve premium quality basesheets as well. (As used herein, a tissue "basesheet" is a tissue sheet as produced on a tissue machine and wound up, prior to any post treatment such as the embossing method of this invention. The tissue basesheet can be layered or blended, creped or uncreped. A tissue "sheet" is a single-ply sheet of tissue, which can be a tissue basesheet or a post-treated tissue basesheet. A tissue "product" is a final product consisting of one or more tissue sheets.) A premium quality tissue sheet has a Strength (hereinafter defined) of 500 grams or greater, a Bulk (hereinafter defined) of 6 cubic centimeters per gram or greater, and a softness, as measured by the Specific Elastic Modulus (hereinafter defined) of 4 or less. The invention utilizes a debonding method in which fine-scale, discrete, intermeshing embossing elements of two gendered (male and female) embossing rolls inelastically strain the tissue sheet, thereby rupturing the weak bonds and opening up the structure both internally and externally. When the method of this invention inelastically strains the sheet externally, the sheet has increased surface fuzziness, which can improve softness. When the method of this invention inelastically strains the sheet internally, the sheet is more limp (less stiff) with a lower Specific Elastic Modulus (increased softness) and significantly greater Bulk. In most cases, the Strength of the sheet is substantially unaffected. Depending on the properties of the sheet to which the method of this invention is applied, the resulting product will have different characteristics, but will always be improved in terms of softness and Bulk, preferably without significant loss of Strength.

New and different tissue sheets and multi-ply tissue products are produced when the method of this invention is applied to wet-pressed or throughdried tissue sheets, including layered or nonlayered (blended) tissue sheets. When the method of this invention is applied to certain blended tissue sheets (wet-pressed or throughdried), softness properties which closely approach the softness characteristics of layered tissue sheets can be obtained by increasing the number of unbonded fiber ends protruding from the surface of the tissue sheet. When the method of this invention is applied to wet-pressed tissue sheets (either layered or blended), the Bulk and softness are improved to the point of being comparable to that of throughdried sheets. For purposes herein, an increase in softness is objectively represented by a decrease in the Specific Elastic Modulus (SEM), which is a measure of stiffness. In all cases, the Strength of the sheet or product is maintained at a useful level of about 500 grams or greater.

Hence in one aspect the invention resides in a method of embossing a tissue sheet comprising passing a tissue sheet through a nip formed between male and female embossing rolls having about 15 or more discrete, intermeshing embossing elements per square centimeter (100 per square inch) of surface which deflect the sheet perpendicular to its plane, wherein the percent increase in Bulk divided by the percent decrease in Strength is about 1 or greater, more specifically from about 1 to about 4, and still more specifically from about 2 to about 3.

In another aspect, the invention resides in a soft wet-pressed tissue sheet having a Bulk of about 6 cubic centimeters per gram or greater, a Specific Elastic Modulus of about 4 kilometers or less and a Strength of about 500 grams or greater.

In another aspect, the invention resides in a two-ply tissue product comprising two wet-pressed tissue sheets, said product having a Bulk of about 9 cubic centimeters per gram or greater, a Specific Elastic Modulus of about 2 kilometers or less and a Strength of about 500 grams or greater.

In another aspect, the invention resides in a soft throughdried tissue sheet having a Bulk of about 9 cubic centimeters per gram or greater, a Specific Elastic Modulus of about 3 kilometers or less and a Strength of about 500 grams or greater.

Suitable tissue basesheets for purposes herein include paper sheets useful for products such as facial tissue, bath tissue, paper towels, dinner napkins, and the like. These sheets can be layered or blended (nonlayered), although the greatest economic benefit can be obtained using blended sheets having a high short fiber content because a product approaching layered quality can be made from a blended basesheet. However, layered sheets can also be improved as well. The tissue basesheets preferably have at least about 20 dry weight percent short fibers, more preferably at least about 40 dry weight percent short fibers, and still more preferably at least about 60 dry weight percent short fibers. Short fibers are natural or synthetic papermaking fibers having an average length of about 2 millimeters (0.08 inches) or less. Generally, short fibers include hardwood fibers such as eucalyptus, maple, birch, aspen and the like. Long fibers are natural or synthetic papermaking fibers having an average length of about 2.5 millimeters (0.1 inch) or greater. Such long fibers include softwood fibers such as pine, spruce and the like.

The basis weight of the tissue sheets of this invention can be from about 5 to about 100 grams per square meter, more specifically from about 10 to about 70 grams per square meter, and still more specifically from about 20 to about 50 grams per square meter.

The tissue sheets of this invention may also be characterized in part by a machine-direction stretch of less than about 30 percent, more specifically from about 10 to about 25 percent, and still more specifically from about 15 to about 20 percent.

The pair of embossing rolls useful herein can be made of steel or rubber. The male embossing roll of the pair contains discrete "male" embossing elements which protrude from the surface of the embossing roll. The female embossing roll of the pair has corresponding "female voids", sometimes referred to as female "elements", which are recessed from the surface of the embossing roll and are positioned and sized to intermesh with the male elements of the other roll. In operation, the intermeshing embossing elements do not perforate the basesheet.

The nip between the embossing rolls can be operated with a fixed gap, fixed load, press pulse, constant nip width, or other such common operating conditions well known in the embossing art. It will herein be referred to as a fixed gap, meaning that the elements do not bottom out as they are engaged. The fixed gap spacing between the embossing rolls will be affected by the relative size and shape of the male elements and the female voids, as well as the basis weight or thickness of the sheet(s) being embossed.

In general, at least 15 discrete, intermeshing male elements per square centimeter (100 per square inch) is preferred to adequately emboss the surface, more specifically from about 30 to about 95 elements per square centimeter (from about 200 to about 600 per square inch), and still more specifically from about 45 to about 75 per square centimeter (from about 300 to about 500 per square inch). While round or generally oval-shaped elements are preferred for surface fiber feel quality, the cross-sectional shape of the male elements can be any shape, provided that the elements are distinct, which means that the elements are not ridges or lines but are instead individual protrusions surrounded by land area on the embossing roll. The shape of the female voids generally corresponds to that of the male elements, but need not be the same. The size of the female void must be sufficiently large to accept the male element and the tissue sheet.

The width and length of the male elements are preferably less than or equal to the average fiber length of the short fiber species within the sheet. Specifically, the width and length of the male elements can be less than about 2.5 millimeters, more specifically from about 0.25 to about 2 millimeters, and still more specifically from about 0.75 to about 1.25 millimeters. As used herein, the width and length of the embossing elements are sometimes collectively referred to as the "size" of the elements as viewed in cross-section. The width and length can be the same or different.

The distance between the male elements on the surface of the roll also is preferably less than or equal to the average short fiber length. Specifically, the distance between the male elements is less than about 2.5 millimeters, more specifically from about 0.25 to about 2.0 millimeters, and still more specifically from about 0.75 to about 1.25 millimeters.

As previously mentioned, the female embossing roll has a pattern of depressions or voids adapted to accommodate the intermeshing male elements. When the male elements are aligned with the female voids prior to engagement, the distance between the sidewalls of the male elements and the sidewall of the female voids at zero engagement is referred to as the "accommodation". The terminology pertaining to the embossing method of this invention is further described in connection with FIG. 10. The degree of accommodation can be from about 0.075 to about 1.25 millimeters, more specifically from about 0.25 to about 0.75 millimeters. In general, accommodation has a significant impact on the Strength loss of the embossing process. As the accommodation decreases, the tissue sheet is subjected to greater shear forces and hence a greater chance of losing Strength.

The "roll engagement", also referred to as the "embossing level", is the distance the male element penetrates the corresponding female void. This distance will in large part determines the Bulk gain imparted by the embossing process. The embossing level can be from about 0.1 to about 1 millimeter, more specifically from about 0.25 to about 0.5 millimeter.

The male elements and female voids can be designed to be matched or unmatched. Matched elements are mirror images of each other, while unmatched elements are not. The unmatched elements can differ in size, depth, and/or sidewall angles. Sidewall angles are preferably in the range of from about 15° to about 25° and are preferably substantially the same for the male elements and the corresponding female voids. In such a case, it is also preferred that the size of the top of the male element be larger than the size of the bottom of the female void to prevent the male element from contacting the bottom of the female void. Embossing elements which are unmatched are preferred, including unmatched elements produced by laser-engraving rubber rolls. Unmatched elements provide greater flexibility in terms of embossing level and accommodation. The use of laser-engraved embossing rolls is described in greater detail in copending application Ser. No. 07/870,528 filed Apr. 17, 1992 in the names of J. S. Veith et al. entitled "Method For Embossing Webs", which is herein incorporated by reference.

In designing the size of the male embossing elements and female voids, it is preferable that the length and width of the male elements is equal to or greater than the distance between surrounding adjacent male elements. If the element size is maintained constant, the density of the elements (the number of elements per square centimeter) can be increased by decreasing the space between the elements. Alternatively, if the density of the elements is maintained constant, the element size can be increased by decreasing the space between the elements. A tissue sheet embossed in accordance with this invention can approach a one-sided feel (both sides of the embossed sheet feel substantially the same) if the accommodation, element size, female roll land distance and the number of elements per unit length are properly balanced (see FIG. 10 for a clarification of these parameters). More specifically, the following equation represents a linear inch (25.4 milimeters) of the embossing pattern taken in cross-section:

$$(2A+B+C)\times D=25.4 \text{ millimeters (1 inch)}$$

where A=accommodation (required on both sides of the element), expressed in millimeters;

B=element size, length or width, expressed in millimeters;

C=female roll land distance, expressed in millimeters; and

D=number of elements per lineal 25.4 millimeters (1 inch).

Some of the parameters have minimum requirements. For example, the land distance of the female roll is limited to a minimum of 0.1016 millimeter (0.004 inch) due to embossing roll manufacturing limitations and for maintaining adequate integrity to run the embossing process. It is also not desireable to design embossing patterns with less than 0.0762 millimeter (0.003 inch) accommodation, which would limit the embossing level and thereby limit bulk generation.

A key to eliminating or minimizing two-sidedness is providing an embossing pattern in which the length and width of the male elements is greater than or equal to the distance between male elements. Stated in terms of the parameters defined above:

$$B \geqq (2A+C)$$

Any combination of accommodation and female roll land distance can be used as long as the above formula is met.

By way of example, set forth below are several combinations of embossing element design parameters within the scope of this invention and which are suitable for producing a one-sided sheet (all dimensions in millimeters):

| Elements per 25.4 Millimeters | Accommodation | Element Size | Female Roll Land Distance |
|---|---|---|---|
| 10 | 0.0762 | 2.286 | 0.1016 |
| 10 | 0.5842 | 1.270 | 0.1016 |
| 10 | 0.0762 | 1.270 | 1.1176 |
| 25 | 0.0762 | 0.762 | 0.1016 |
| 25 | 0.2032 | 0.508 | 0.1016 |
| 25 | 0.0762 | 0.508 | 0.3556 |

As used herein, Strength is the geometric mean tensile (GMT) strength, which is the square root of the product of the machine direction (MD) tensile strength and the cross-machine direction (CD) tensile strength of the tissue sheet. The MD tensile strength, MD stretch, CD tensile strength, and CD stretch are determined in accordance with TAPPI test method T 494 om-88 using flat gripping surfaces (4.1.1, Note 3), a jaw separation of 2.0 inches (or 50.8 millimeters), a crosshead speed of 10 inches (or 254 millimeters) per minute. The units of Strength are grams per 3 inches (or 76.2 millimeters) of sample width, but for convenience are herein reported simply as "grams."

The Bulk of the products of this invention is calculated as the quotient of the Caliper (hereinafter defined), expressed in microns, divided by the basis weight, expressed in grams per square meter. The resulting Bulk is expressed as cubic centimeters per gram.

The Caliper, as used herein, is the thickness of a single sheet, but measured as the thickness of a stack of ten sheets and dividing the ten sheet thickness by ten, where each sheet within the stack is placed with the same side up. It is measured in accordance with TAPPI test methods T402 "Standard Conditioning and Testing Atmosphere for Paper, Board, Pulp Handsheets and Related Products" and T411 om-89 "Thickness (Caliper) of Paper, Paperboard, and Combined Board" with Note 3 for stacked sheets. The micrometer used for carrying out T411 om-89 is a Bulk Micrometer (TMI Model 49-72-00, Amityville, N.Y.) having an anvil pressure of 220 grams per square inch (3.39 kiloPascals) and an anvil diameter of 4 1/16 inches (103.2 millimeters). After the Caliper is measured, the same ten sheets in the stack are used to determine the average basis weight of the sheets.

As used herein, Specific Elastic Modulus (SEM) is determined by measuring the slope of a particular portion of the machine-direction stress/strain curve for the tissue in question. The SEM is calculated as the slope of the machine direction stress/strain curve (expressed in kilograms per 76.2 millimeters of sample width) measured between a stress of 100 and 200 grams, divided by the product of 0.0762 times the basis weight (expressed in grams per square meter). The SEM is expressed in kilometers and is an objective measure of tissue softness.

DETAILED DESCRIPTION OF THE DRAWINGS

Figure 1:
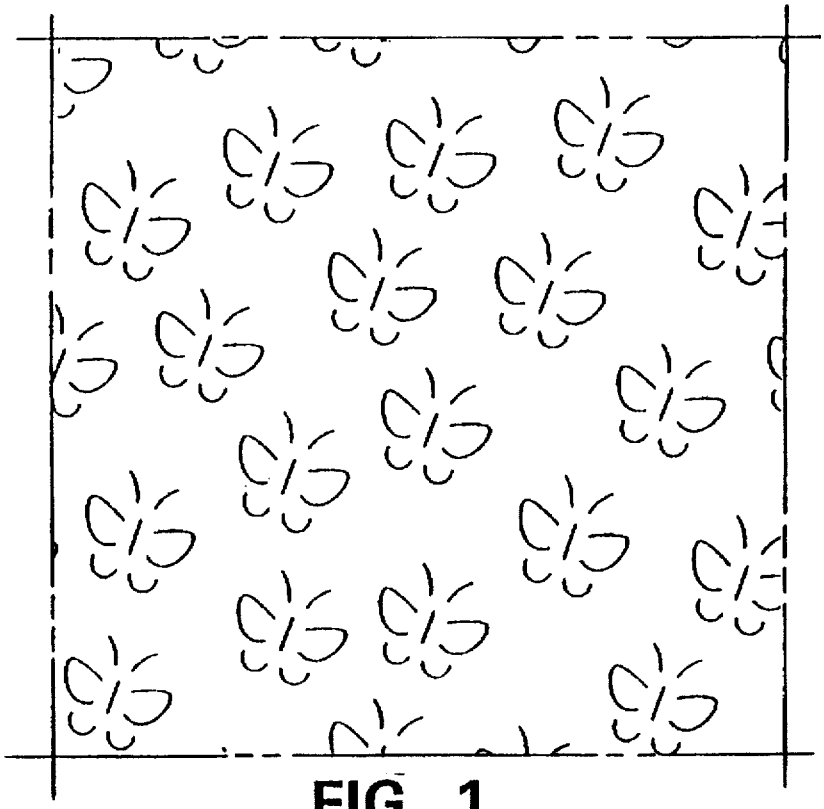
FIG. 1 (PRIOR ART)
FIG. 1 is a plan view of a prior art butterfly embossing pattern, illustrating the shape of the male embossing elements.

FIG. 1 is a plan view of a prior art decorative butterfly embossing pattern produced on laser-engraved embossing rolls, illustrating the shape of the male embossing elements. The male butterfly embossing elements had a line thickness of 0.71 millimeters (0.028 inch), a depth of 1.6 millimeters (0.062 inch) and a sidewall angle of 22°. The matching female void was 1.4 millimeters wide (0.057 inch), 1.3 millimeters deep (0.053 inch) and had a 19° sidewall angle. The butterfly was 17.5 millimeters long (0.6875 inch) by 15.9 millimeters wide (0.625 inch), and there were 0.2131 butterflies per square centimeter (1.375 butterflies per square inch). Seven different elements made up the butterfly pattern to provide an embossing area of about 10 percent.

Figure 2:
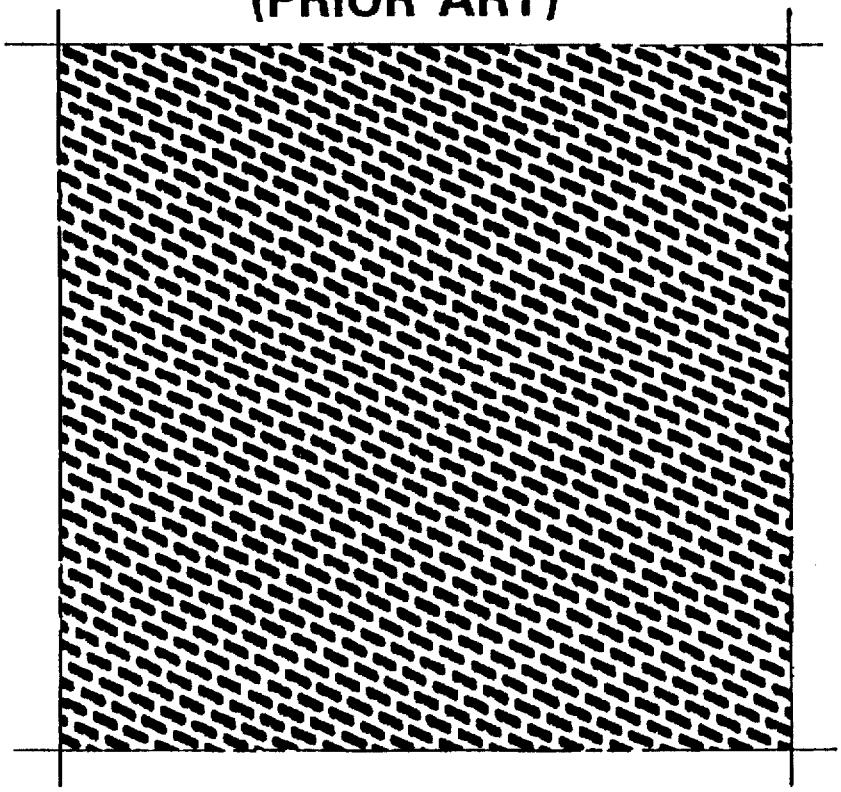
FIG. 2 is a plan view of an embossing pattern useful in accordance with this invention (magnified 2×), illustrating the shape and spacing of the male embossing elements.

FIG. 2 is a plan view of an embossing pattern useful in accordance with this invention, illustrating the size and spacing of the male embossing elements. For this pattern, the male elements had a height (or depth) of 0.76 millimeters, a length of 1.52 millimeters and a width of 0.508 millimeters, hence having a length:width ratio of 3:1. The major axes of the elements were oriented at an angle of 65° relative to the circumferential direction of the roll. There were an average of 0.5 elements per millimeter in the axial direction of the roll and an average of 1.1 elements per millimeter in the circumferential direction of the roll, resulting in an element density of 57 discrete elements per square centimeter. The female roll in the nip contained corresponding voids positioned to receive the male elements having a depth of 0.81 millimeters, a length of 2.03 millimeters and a width of 1.02 millimeters. The voids were correspondingly oriented with the major axes at an angle of 65° to the circumferential direction of the roll. The land area between the voids was 0.15 millimeters with an accommodation between the intermeshing elements of 0.25 millimeters. The side wall angle of the male element and the female void was 18°. The embossing area was about 45 percent.

Figure 3:
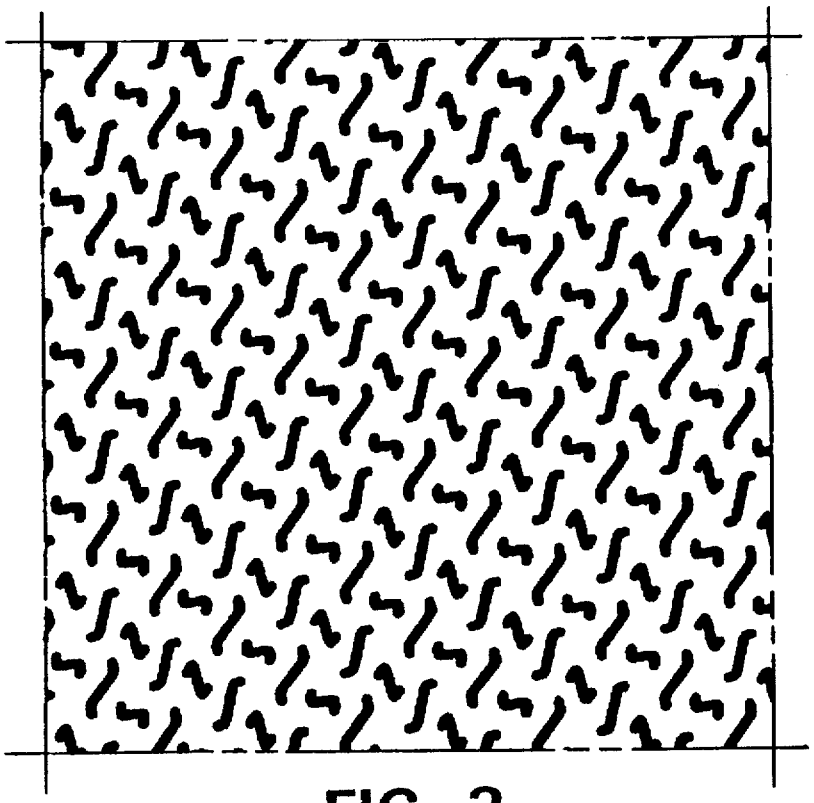
FIG. 3 is a plan view of an embossing pattern not useful in accordance with this invention (magnified 2×), illustrating the shape and spacing of the male embossing elements.

FIG. 3 is a plan view of an embossing pattern not useful in accordance with this invention, illustrating the shape and spacing of the male embossing elements. For this pattern, the male elements had a depth of 8.6 millimeters (0.34 inch), an element surface area of 0.035 square centimeters (0.0055 square inch), a sidewall angle of 33°, an element density of 8.5 elements per square centimeter (55 elements per square inch), and a repeat unit length of 7.6 millimeters (0.3 inch). The embossing area was about 30 percent.

Figure 4:
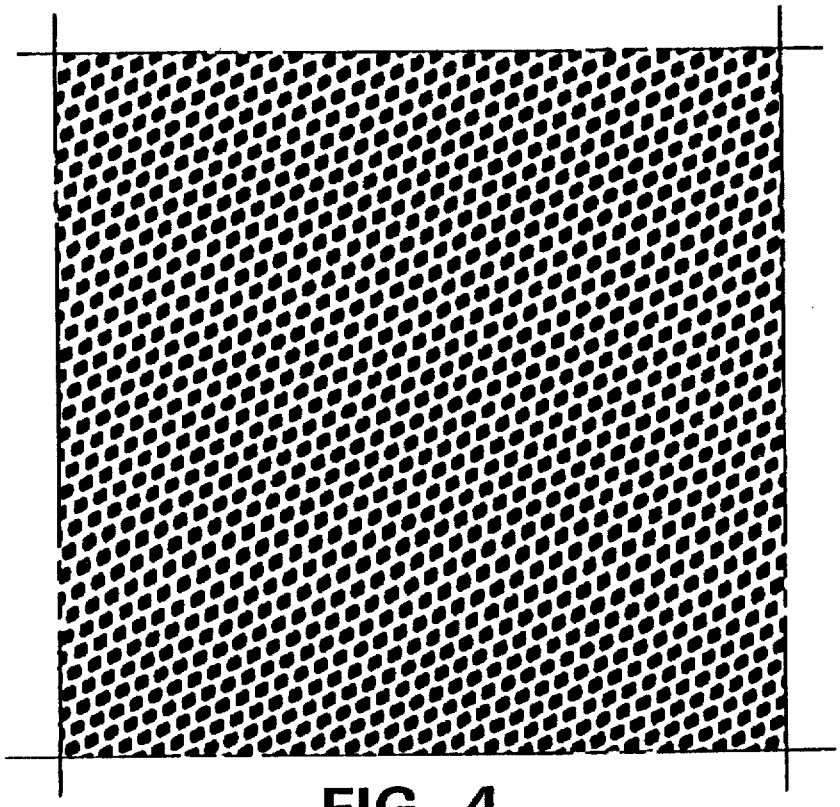
FIG. 4 is a plan view of another embossing pattern useful in accordance with this invention (magnified 2×), illustrating the shape and spacing of the male embossing elements.

FIG. 4 is a plan view of another embossing pattern useful in accordance with this invention, illustrating the size and spacing of the male embossing elements. For this pattern, there were 39.6 discrete intermeshing elements per square centimeter (256 elements per square inch). Each element was 0.84 millimeter long (0.033 inch) by 0.84 millimeter wide (0.033 inch) and had an 18° sidewall angle. The corresponding female void was 1.09 millimeter long (0.043 inch) by 1.09 millimeter wide (0.043 inch), leaving 0.127 millimeter (0.005 inch) accommodation between the two intermeshing elements. The land distance between the female voids was 0.20 millimeter (0.008 inch) for a total of 0.46 millimeter (0.018 inch) between the individual male elements. The embossing area was about 28 percent.

Figure 5:
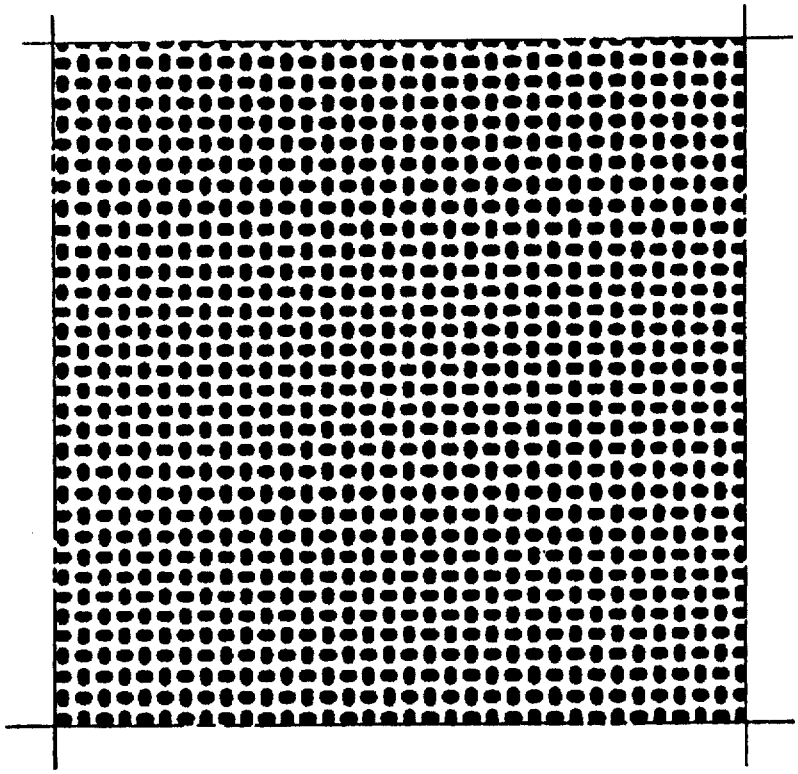
FIG. 5 is a plan view of another embossing pattern useful in accordance with this invention (magnified 2×), illustrating the shape and spacing of the male embossing elements.

FIG. 5 is a plan view of another embossing pattern useful in accordance with this invention (magnified 2×), illustrating the shape and spacing of the male embossing elements. The male roll had approximately 50.2 discrete protruding male embossing elements per square centimeter (324 per square inch). Each element was 0.38 millimeters wide (0.015 inch) by 0.76 millimeters long (0.030 inch), with every other element rotated 90°. The sidewall angle of the elements was 20°. The distance between the male protruding elements was 1.01 millimeters (0.040 inch). The corresponding female void was 1.14 millimeters wide (0.045 inch) by 1.52 millimeters long (0.060 inch), matching the orientation of the male element. The accommodation between the intermeshing elements was 0.38 millimeters (0.015 inch) and the land distance between the female voids was 0.25 millimeters (0.010 inch). The embossing area was about 15 percent.

Figure 6:
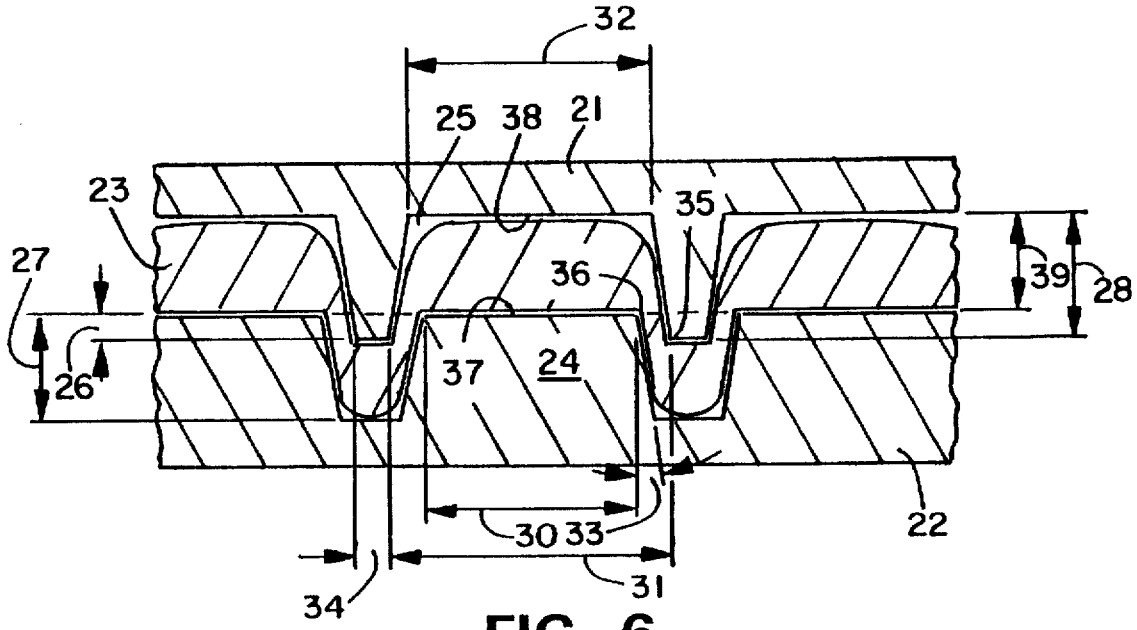
FIG. 6 is a schematic view of a tissue sheet being embossed in accordance with this invention, illustrating the intermeshing of the male embossing elements and corresponding female voids.

FIG. 6 is a schematic view of a tissue sheet being embossed in accordance with this invention, illustrating the intermeshing relationship of the male elements and female voids. Shown is the female embossing roll 21, the male embossing roll 22 and the tissue basesheet 23 being embossed. The male embossing element 24 is shown as partially engaging the female void 25. The degree of roll engagement or embossing level is indicated by the distance 26, which is the distance that the male element penetrates the female void. The depth of the male element is indicated by reference numeral 27. The depth of the female void is indicated by reference numeral 28. The size of the male element (length or width, depending on the orientation of the element relative to the cross-sectional view) is indicated by reference numeral 30. The size of the female void is similarly indicated by reference numeral 31. The size of the bottom or base of the female void is indicated by reference numeral 32. The land area between the female voids is indicated by reference numeral 34. The sidewall angle of the male elements and female voids is measured relative to a line which is perpendicular to the surface of the rolls. The sidewall angle of the male element is shown as reference numeral 33. The accommodation is the distance between the male element sidewalls and the female void sidewalls at zero engagement. Although the elements in FIG. 6 are not at zero engagement, the accommodation would be the distance between points 35 and 36 at zero engagement. As the elements are engaged, the distance between the sidewalls decreases, causing shearing of the tissue to create a permanent deformation and a corresponding bulk increase. It is believed to be important that the male elements do not inelastically compress the tissue between the top 37 of the male element and the bottom 38 of the female void. That is to say, referring to FIG. 6, that the distance 39 is not less than the thickness of the tissue.

Figure 7:
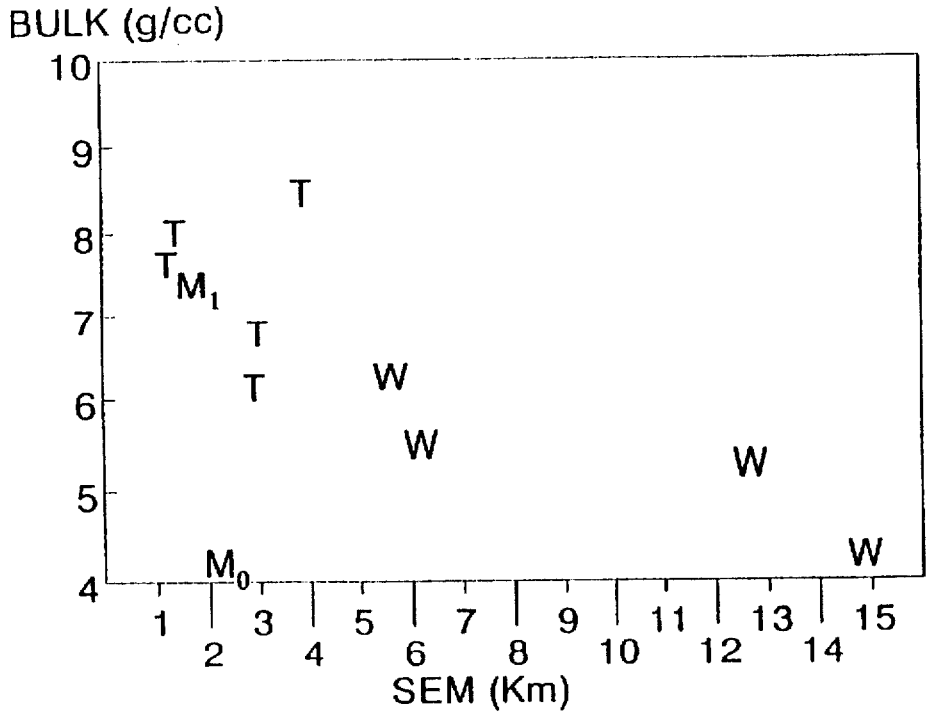
FIG. 7 is a plot of Bulk versus SEM for commercially available single-ply tissue products (wet-pressed and throughdried), illustrating how the method of this invention can impart throughdried-like qualities to a wet-pressed sheet. (This plot includes the data from Table 3.)

FIG. 7 is a plot of Bulk versus SEM for commercially available single-ply tissue products, illustrating how the method of this invention can be used to impart throughdried-like qualities to a wet-pressed sheet. The commercially available wet-pressed tissues are labelled "W". The commercially available throughdried tissues are labelled "T". Note that the throughdried products have a lower SEM than the wet-pressed tissues, indicating greater softness. In general, the throughdried tissues also have greater Bulk. The point labelled $M_0$ is a wet-pressed control sample, and the point labelled $M_1$ is the product resulting from applying the method of this invention to the control sample. (See Table 3 for specific data). Note that the Bulk of the wet-pressed product has been elevated to the level of the throughdried products.

Figure 8:
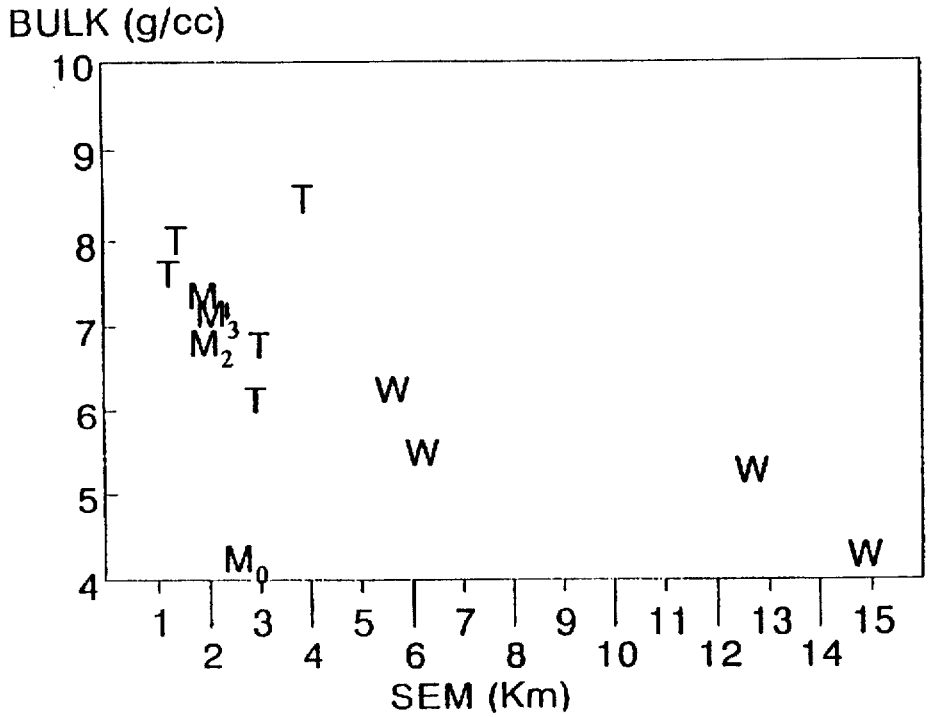
FIG. 8 is a plot similar to that of FIG. 7, but illustrating the improvement in Bulk as a function of different embossing levels. (This plot includes the data from Table 4.)

FIG. 8 is a plot containing the same commercially available wet-pressed and throughdried products of FIG. 7, but illustrating the improvements in Bulk for differing levels of embossing roll engagement (embossing level). Specifically, the wet-pressed tissue control sample is represented as "$M_0$" was subjected to the method of this invention at different levels of engagement. The resulting products are represented by points $M_2$, $M_3$, and $M_4$. Specific data is presented in Table 4. As shown, these products possess a combination of softness, Strength and Bulk not exhibited by the prior art wet-pressed products.

Figure 9:
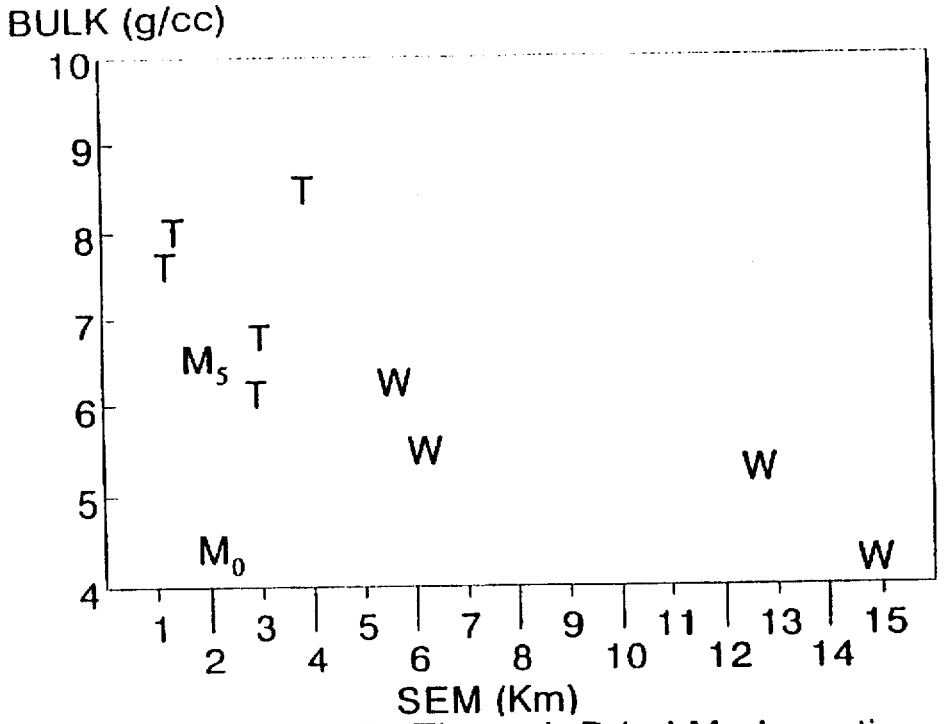
FIG. 9 is a plot similar to that of FIG. 7, but showing the improvement in Bulk for a different basesheet. (This plot includes the data from Table 5.)

FIG. 9 is a plot similar to FIG. 7, illustrating the improvement in Bulk attained by applying the method of this invention to a different control wet-pressed basesheet. As before, the starting material is designated $M_0$ and the product of this invention is designated as $M_5$. Specific data is presented in Table 5.

Figure 10:
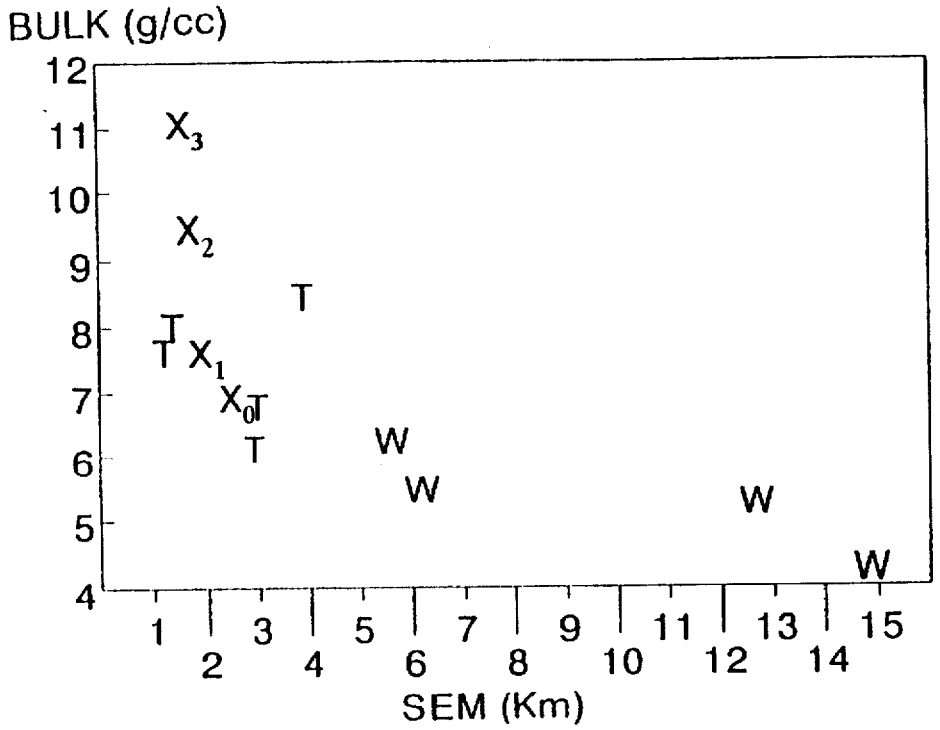
FIG. 10 is a plot similar to that of FIG. 7, but showing the improvement in Bulk for a throughdried basesheet. (This plot includes the data from Table 8.)

FIG. 10 is a plot similar to FIG. 7, illustrating the improvement in Bulk attained by applying the method of this invention to a throughdried control basesheet using different embossing levels. The control basesheet is designated as $X_0$ and the resulting products are designated $X_1$, $X_2$, and $X_3$. As shown, the throughdried products can be elevated to Bulk levels not exhibited by the commercially available throughdried products. Specific data is presented in Table 8.

EXAMPLES

To further illustrate the invention, the methods of making the tissue products of this invention plotted in FIGS. 7, 8, 9 and 10 will be described in detail below.

Example 1

A blended tissue sheet was made with 70% Caima sulfite eucalyptus and 30% northern softwood kraft and was embossed between unmatched laser-engraved rubber embossing rolls having an embossing pattern as illustrated in FIG. 2 having an embossing level of 0.20 millimeters (0.008 inch). The embossed sheets were plied together with a like sheet by crimping the edges of the sheets to produce a two-ply product having a finished basis weight of 44 grams per square meter (gsm), a Bulk of 7.04 cubic centimeters per gram and a Strength of 784 grams per 7.62 centimeters.

Example 2

A one-ply, blended, wet-pressed tissue basesheet was made with a furnish comprising 70% Cenibra eucalyptus bleached kraft and 30% northern softwood kraft having a dryer basis weight of 27.5 grams per square meter (16.2 pounds per 2880 square feet) and a finished basis weight of 33.9 grams per square meter (19.9 pounds per 2880 square feet). The machine speed was 396 meters per minute (1300 feet per minute), using no refiner or wet strength agents. The resulting basesheet had a machine direction stretch of 24 percent, a Bulk of 4.2 cubic centimeters per gram, a Strength of 1025 grams and a SEM of 2.30 kilometers. This basesheet is designated as the Control sample.

The Control basesheet was embossed with a matched steel embossing pattern as illustrated in FIG. 3. The basesheet was embossed at incremental levels to generate a Bulk gain/Strength loss relationship. Table 1 below shows the resulting data. (For all of the data listed in the following tables, "Embossing Level" is expressed in millimeters, "Basis Weight" is expressed in grams per square meter, "Strength" is expressed in grams per 76.2 millimeters of sample width, "Bulk" is expressed in cubic centimeters per gram, "SEM" (Specific Elastic Modulus) is expressed in kilometers, and "RATIO" is the ratio of the percent increase in Bulk divided by the percent decrease in Strength.

TABLE 1

| SAMPLE | EMBOSSING LEVEL | BASIS WEIGHT | STRENGTH | BULK | SEM | RATIO |
|---|---|---|---|---|---|---|
| Control | | 33.89 | 1025 | 4.20 | 2.30 | — |
| 1 | 0.1778 | 31.85 | 1022 | 4.15 | 3.08 | 0 |

TABLE 1-continued

| SAMPLE | EMBOSSING LEVEL | BASIS WEIGHT | STRENGTH | BULK | SEM | RATIO |
|---|---|---|---|---|---|---|
| 2 | 0.2794 | 30.57 | 962 | 4.32 | 3.75 | 0.47 |
| 3 | 0.3810 | 31.31 | 847 | 4.70 | 2.64 | 0.69 |
| 4 | 0.4826 | 30.57 | 689 | 4.90 | 2.52 | 0.51 |

In all cases the resulting basesheet did not meet all three of the criteria of Strength, softness (SEM), and Bulk for a premium tissue product.

The Control basesheet was also embossed with a set of unmatched laser-engraved rolls having a butterfly pattern as shown in FIG. 5.

Again, the basesheet was embossed at various levels to obtain a Bulk gain/Strength loss relationship. Table 2 below shows the resulting data:

TABLE 2

| SAMPLE | EMBOSSING LEVEL | BASIS WEIGHT | STRENGTH | BULK | SEM | RATIO |
|---|---|---|---|---|---|---|
| Control | | 33.89 | 1025 | 4.20 | 2.30 | — |
| 1 | 0.2540 | 31.33 | 1025 | 4.46 | 2.91 | 0 |
| 2 | 0.3810 | 31.75 | 945 | 4.56 | 2.38 | 1.10 |
| 3 | 0.5080 | 31.85 | 832 | 4.46 | 3.19 | 0.33 |
| 4 | 0.6350 | 32.50 | 737 | 5.24 | 2.00 | 0.88 |

Again, the resulting basesheet did not meet all three of the criteria for Strength, softness (SEM) and Bulk for a premium product. Sample 2 did exhibit a Ratio greater than 1, but this was obtained because the Bulk increase was so low (9%) that the Strength was not significantly impacted. Also, the differences in Bulk and Strength values are within basesheet variability and testing deviation.

Example 3

The same Control basesheet described in Example 2 was embossed in accordance with this invention with a laser-engraved micro pattern as illustrated in FIG. 2 to obtain the Strength, softness (SEM) and Bulk of a premium tissue product. Table 3 below shows the resulting data:

TABLE 3

| SAMPLE | EMBOSSING LEVEL | BASIS WEIGHT | STRENGTH | BULK | SEM | RATIO |
|---|---|---|---|---|---|---|
| $M_0$ | | 33.89 | 1025 | 4.20 | 2.30 | — |
| $M_1$ | 0.3556 | 30.02 | 629 | 7.36 | 1.80 | 1.95 |

The resulting basesheet met the premium criteria of strength, softness (SEM) and bulk.

The micro embossing pattern described above was used to emboss a different control basesheet at various embossing levels. All process conditions were as described in Example 2 except for the furnish blend, in which a portion of the eucalyptus was substituted with Caima eucalyptus, which is a sulfite pulp exhibiting less bonding potential than the Cenibra eucalyptus. The overall make-up of the blended base sheet was 35 percent Cenibra eucalyptus/35 percent Caima eucalyptus/30 percent northern softwood kraft. The resulting data is listed in Table 4 below:

TABLE 4

| SAMPLE | EMBOSSING LEVEL | BASIS WEIGHT | STRENGTH | BULK | SEM | RATIO |
|---|---|---|---|---|---|---|
| $M_0$ | — | 32.40 | 1092 | 4.23 | 2.67 | — |
| $M_2$ | 0.2540 | 30.24 | 815 | 6.80 | 2.02 | 2.39 |
| $M_3$ | 0.2794 | 29.16 | 765 | 7.14 | 2.16 | 2.30 |
| $M_4$ | 0.3048 | 30.02 | 731 | 7.36 | 2.00 | 2.24 |

Again, the resulting basesheet met the premium criteria of Strength, softness (SEM) and Bulk.

The same micro embossing pattern described above was applied to a Control basesheet made as described in Example 2, but having a lower dryer basis weight of 24.7 grams per square meter (14.6 pounds per 2880 square feet). The overall make-up of the blended Control basesheet was 70 percent Cenibra eucalyptus and 30 percent northern softwood kraft. The embossing level was 0.25 millimeters (0.010 inch). The resulting data is listed in Table 5 below:

TABLE 5

| SAMPLE | EMBOSSING LEVEL | BASIS WEIGHT | STRENGTH | BULK | SEM | RATIO |
|---|---|---|---|---|---|---|
| $M_0$ | | 29.92 | 935 | 4.41 | 2.16 | — |
| $M_5$ | 0.2540 | 28.41 | 666 | 6.52 | 1.92 | 1.66 |

The result was that the embossed basesheet met the premium criteria of Strength, softness (SEM) and Bulk.

Example 4

A different wet-pressed Control basesheet was embossed in accordance with this invention between a pair of laser-engraved embossing rolls having the embossing pattern described and illustrated in connection with FIG. 4. The Control basesheet was produced on a crescent former and was layered. The wire side (dryer side) layer was 100 percent Cenibra eucalyptus and the roll side (air side) layer was a blend of 40 percent northern softwood kraft and 60 percent broke. The weight ratio of the two layers was 50/50. The dryer basis weight of the Control basesheet was 12.1 grams per square meter (7.17 pounds per 2880 square feet). The basesheet was embossed with the dryer side of the basesheet being contacted by the male embossing roll and a roll engagement of 0.25 millimeters (0.010 inch). Like embossed basesheets were then plied together, dryer side out, by crimping the edges together to form a two-ply tissue. The resulting data is listed in Table 6 below:

TABLE 6

| SAMPLE | EMBOSSING LEVEL | BASIS WEIGHT | STRENGTH | BULK | SEM | RATIO |
|---|---|---|---|---|---|---|
| Control | | 30.23 | 743 | 8.35 | 1.90 | — |
| 1 | 0.2540 | 27.96 | 550 | 9.01 | 1.73 | 0.30 |

Both the Control and embossed sample met the premium criteria of Strength, softness (SEM) and Bulk, but the embossed sample had improved softness and Bulk, although there was a decrease in Strength.

Example 5

A one-ply, throughdried, layered basesheet was produced using a twin-wire former. This Control basesheet was embossed between a laser-engraved male embossing roll (having the butterfly embossing pattern described in FIG. 1) and a 60 durometer smooth rubber roll over a range of loads to obtain a Strength loss/Bulk gain relationship. The resulting data is listed in Table 7 below:

TABLE 7

| SAMPLE | EMBOSSING LEVEL | BASIS WEIGHT | STRENGTH | BULK | SEM | RATIO |
|---|---|---|---|---|---|---|
| Control | | 28.77 | 996 | 6.89 | 2.58 | — |
| 1 | 23.8125 | 28.77 | 779 | 7.77 | 2.06 | 0.52 |
| 2 | 25.4000 | 28.41 | 739 | 7.78 | 2.23 | 0.50 |
| 3 | 30.1625 | 28.57 | 572 | 8.45 | 2.58 | 0.53 |

The Control sheet met the Strength, softness (SEM) and Bulk criteria for a premium tissue product. Embossing the basesheet with the butterfly pattern resulted in a 42% Strength loss for a 23% Bulk increase with no change in SEM. The percent Bulk increase per percent Strength decrease was 0.55.

For comparison, the one-ply throughdried basesheet listed above was embossed in accordance with this invention using a set of intermeshing laser-engraved rolls having the embossing pattern described in FIG 5. The basesheet was embossed over a range of roll engagements to produce a Strength loss/Bulk increase relationship. The resulting data is listed in Table 8 below:

TABLE 8

| SAMPLE | EMBOSSING LEVEL | BASIS WEIGHT | STRENGTH | BULK | SEM | RATIO |
|---|---|---|---|---|---|---|
| $X_0$ | | 28.77 | 996 | 6.89 | 2.58 | — |
| $X_1$ | 0.2032 | 28.14 | 852 | 7.58 | 2.00 | 0.70 |
| $X_2$ | 0.3048 | 27.79 | 725 | 9.41 | 1.81 | 1.34 |
| $X_4$ | 0.4064 | 27.63 | 555 | 11.03 | 1.66 | 1.36 |

Micro embossing the same sheet in accordance with this invention resulted in a 60% increase in Bulk for the same 44% decrease in Strength as the butterfly with a 36% decrease in SEM.

It will be appreciated that the foregoing examples, given for purposes of illustration, are not to be construed as limiting the scope of this invention, which is defined by the following claims and all equivalents thereto.

We claim:

1. A two-ply tissue product comprising two wet-pressed tissue sheets, said product having a bulk of about 9 cubic centimeters per gram or greater, a specific elastic modulus of about 3 kilometers or less and a geometric mean tensile strength of about 500 grams or greater per 3 inches sample width.

2. A soft wet-pressed tissue sheet having a bulk of about 6 cubic centimeters per gram or greater, a specific elastic modulus of about 4 kilometers or less, and a geometric mean tensile strength of about 500 grams or greater per 3 inches sample width.

3. The tissue sheet of claim 2 having a bulk of about 7 cubic centimeters per gram or greater and a specific elastic modulus of about 3 kilometers or less.

4. The tissue sheet of claim 2 having a bulk of about 7 cubic centimeters per gram or greater and a specific elastic modulus of about 2 kilometers or less.

5. A soft throughdried tissue sheet having a bulk of about 9 cubic centimeters per gram or greater, a specific elastic modulus of about 3 kilometers or less and a geometric mean tensile strength of about 500 grams or greater per 3 inches sample width.

6. The tissue sheet of claim 5 having a specific elastic modulus of about 2 kilometers or less.

* * * * *